United States Patent [19]

Larsson

[11] Patent Number: 4,607,712

[45] Date of Patent: Aug. 26, 1986

[54] ROCK DRILL BIT

[75] Inventor: Lars E. Larsson, Sandviken, Sweden

[73] Assignee: Santrade Limited, Lucerne, Switzerland

[21] Appl. No.: 683,565

[22] Filed: Dec. 19, 1984

[30] Foreign Application Priority Data

Dec. 19, 1983 [SE] Sweden ..... 8307010

[51] Int. Cl.[4] ..... E21B 10/16; E21B 10/52

[52] U.S. Cl. ..... 175/410

[58] Field of Search ..... 175/389, 410, 414

[56] References Cited

U.S. PATENT DOCUMENTS

| | | | |
|---|---|---|---|
| 1,516,601 | 11/1924 | Hawkesworth . | |
| 2,689,109 | 9/1954 | Curtis | 175/410 |
| 3,145,791 | 8/1964 | Schlossin | 175/410 |
| 3,269,470 | 8/1966 | Kelly, Jr. | 175/410 |
| 4,296,825 | 10/1981 | Larsson | 175/410 |
| 4,406,337 | 9/1983 | Dill | 175/410 |

FOREIGN PATENT DOCUMENTS

| | | |
|---|---|---|
| 975389 | 9/1975 | Canada . |
| 404055 | 9/1978 | Sweden . |
| 1434197 | 5/1976 | United Kingdom . |
| 1564369 | 4/1980 | United Kingdom . |
| 2031047 | 4/1980 | United Kingdom . |

*Primary Examiner*—Stephen J. Novosad
*Assistant Examiner*—William P. Neuder
*Attorney, Agent, or Firm*—Burns, Doane, Swecker & Mathis

[57] ABSTRACT

Rock drill bit of the impact type comprising a cylindrical body and a front surface provided with fixed peripherally spaced inserts. The head section of each insert comprises a first and a second working surface. The first working surface is arched in the radial direction of the rock drill bit but planar in a direction perpendicular thereto. The second working surface is quarter-spherical and turned towards the center of the rock drill bit. A transition portion extends between the first working surface and the jacket surface of the insert. The transition portion determines the diameter of the bore.

9 Claims, 5 Drawing Figures

ROCK DRILL BIT

BACKGROUND AND SUMMARY OF THE INVENTION

The present invention relates to a rock drill bit of the impact type comprising a mainly cylindrical body and a front surface, provided with a number of fixed peripherally spaced inserts, each said insert having a body with a generally cylindrical jacket surface and a head section protruding axially outwardly from the front surface.

Rock drill bits of the above-captioned type have inserts with semi-spherical head sections. A drawback of this shaping is that the semi-sphere is being worn to a conical configuration at the part of the working end which is turned away from the centre axis of the rock drill bit. The conical configuration adversely affects the boring rate so that the necessary feed force will increase and so that the rock drill bit tends to follow cracks in the rock material. The rock drill bit will thus be guided in a negative manner so that the bore gets inclined in the longitudinal direction and therefore a regrinding of the inserts will be necessitated after only a short period of drilling. Also in the beginning of the drilling there is a need for a large feed force because the semi-spherical shape itself to a certain degree contains a conical configuration.

The object of the present invention is to provide an improved rock drill bit in which the inserts have a configuration that makes it possible to drill with a constant boring rate during long drilling intervals without resistance from any conical configuration and without regrinding of the head section of each insert.

BRIEF DESCRIPTION OF THE DRAWING

The exact nature of the present invention will become more clearly apparent upon reference to the following detailed specification taken in connection with the accompanying drawings in which.

DETAILED DESCRIPTION OF A PREFERRED EMBODIMENT OF THE INVENTION

Figure 1:
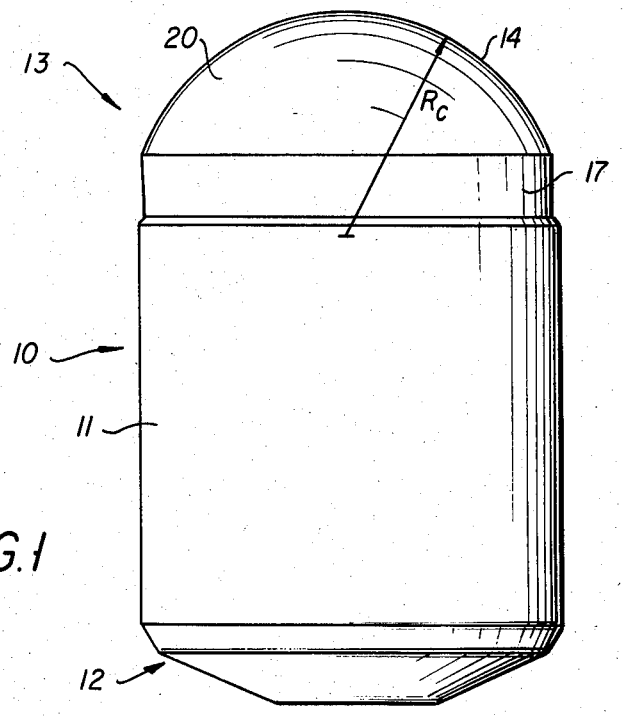
FIGS. 1, 2 and 3 are a side view, a top view and another side view, respectively, of an insert.
Figure 3:
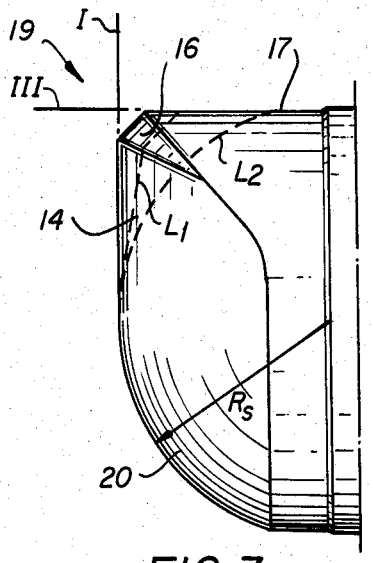
Figure 2:
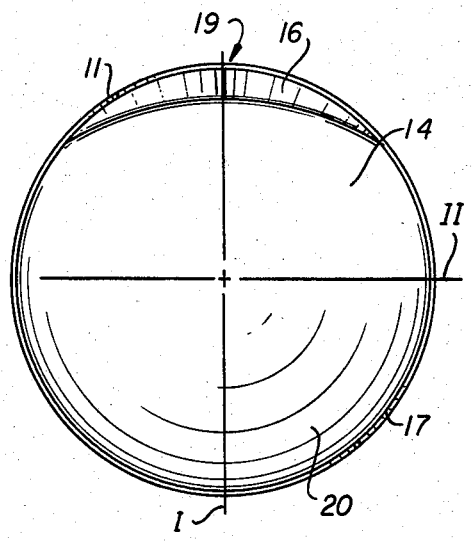

In FIGS. 1, 2 and 3 an insert 10 for a rock drill bit is shown, comprising a generally cylindrical body 11 having a base section 12 and a head section 13. The base section 12 is arranged to be inserted into a drilled insert socket in the rock drill bit so that the head section 13 protrudes from the front surface of the rock drill bit. The head section 13 is provided with a first and a second working surface 14 and 20, respectively. The first working surface 14 is arched in at least one direction and it is limited by the imaginary reference line II or plane in FIGS. 2 and 3, the transition portion 19 and the jacket surface 17. The transition portion 19 is provided with a bevel 16 which extends outwardly and rearwardly from the first working surface 14 towards the jacket surface 17 in order to counteract crack formations in the insert 10 as a sharp edge between the working surface 14 and the jacket surface 17 is avoided. The second working surface 20 has a generally quarter-spherical configuration, the radius $R_s$ of which is equal to the radius $R_c$ of the first working surface 14 and therefore they form a smooth continuation of each other at the line II in FIG. 2. The head section 13 is symmetrically shaped with respect to the line I in FIG. 2, but asymmetrically shaped relative to the line or plane II. The line 1 is perpendicular to the line II. The radii $R_c$ and $R_s$ are at least 10 percent longer than the radius of the body 11. The part of the head section 13 wherein the bevel 16 is broadest is to be farthest away from the centre of the rock drill bit. During the boring operation it is advantageous that this part contains a lot of hard material relative to the conventional semi-spherical configuration shown as a dotted line $L_2$ in FIG. 3. Therefore it is possible to wear off a lot of hard material before the head section becomes conically shaped and therefore the boring interval can be extended and the drill bit will bore in a straighter manner than a drill bit provided with conventional inserts.

The general radius of the transition portion 19 as seen in FIG. 2 is longer than the radius of the insert 10. The part of the first working surface 14 which coincides with the line I in FIG. 3 is perpendicular to the line III, which is an extension of the part of the jacket surface which is farthest away from the centre of the rock drill bit. This part of the first working surface 14 may also be vaulted as seen as a dotted line $L_1$ in FIG. 3 which results in a point contact engagement between the insert and the rock material. A point contact engagement requires less feed forces on the rock drill bit.

Figure 4:
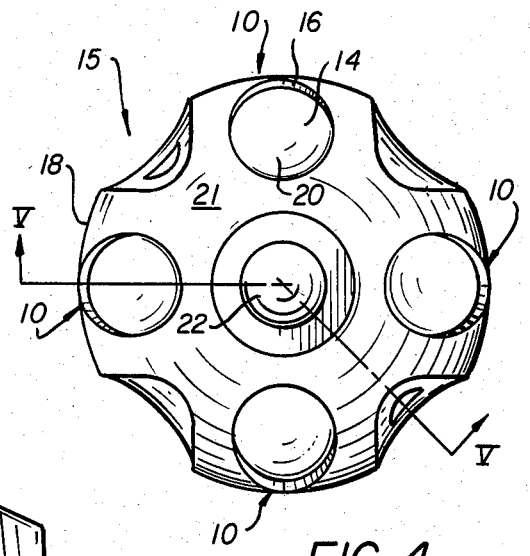
FIGS. 4 and 5 are a top view and a side view, respectively, of the rock drill bit according to the invention.
Figure 5:
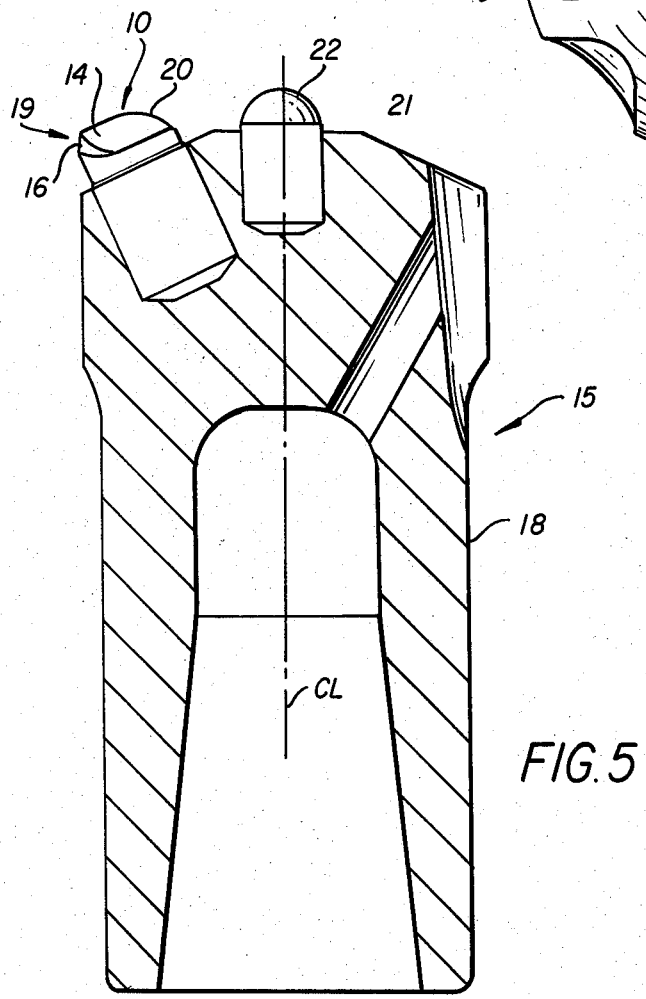

FIGS. 4 and 5 show the rock drill bit of the present invention in a top view and in a crossectional side view according to the line V—V in FIG. 4, respectively. The rock drill bit 15 comprises a mainly cylindrical body 18 and a front surface 21 provided with four fixed peripherally spaced inserts 10 and a central front insert 22. The inserts 10 are acutely inclined relative to the centre line CL of the drill bit.

The inserts 10 are inserted in drilled sockets and the part of each insert that contains the transition portion 19 is turned away from the centre line CL of the rock drill bit 15 so that the transition portion 19 generally determines the diameter of the bore. The broadest part of the bevel 16 is farthest away from the centre line CL and therefore the insert 10 presents a configuration that is more resistant to wear relative to the conventional semi-spherical configuration. The quarter-spherical second working surface 20 of the insert 10 is thus turned towards the centre line CL of the drill bit. This second working surface 20 is exposed to lesser wear than the surface 14 and therefore it has the material-saving quarter-spherical configuration. The inserts 10 may be combined with conventional inserts around the periphery of the rock drill bit.

Thus, the present invention relates to a rock drill bit having inserts with a higher degree of "sharpness" than conventional semi-spherical inserts. The improved inserts can be worn during a long period of boring without achieving a conical configuration. Therefore, this rock drill bit may be used during a long period of boring without regrinding . It also bores straighter holes in the rock material than rock drill bits having conventional semi-spherical inserts.

I claim:

1. Rock drill bit of the impact type comprising a substantially cylindrical body and a front surface provided with a plurality of fixed peripherally spaced inserts, each said insert having a body with a generally cylindrical jacket surface defining a longitudinal axis and a head section protruding outwardly from said front surface in a direction oriented at an acute angle relative to a longitudinal axis of said bit body, said head section being substantially circular as viewed along said longitudinal axis of said insert and provided with first and second working surfaces, said first working surface being arched in at least one direction, said second working surface being spherical and configured as substantially one-quarter of a sphere, a part of a junction between said first working surface and said jacket surface comprising a beveled transition surface such that said head section is configured asymmetrically about an imaginary plane which contains said longitudinal axis of said insert and which imaginary plane is oriented such that said transition surface and said second working surface lie on opposite sides of said plane, said transition surface being turned to face away from said longitudinal axis of said bit body and arranged to generally determine the diameter of a bore cut by said bit.

2. Rock drill bit according to claim 1, wherein said first working surface has a larger radius of curvature in the radial direction of the rock drill bit than in a direction perpendicular to the radial direction.

3. Rock drill bit according to claim 1, wherein the first working surface has a generally straight extension in the radial direction of the rock drill bit and a constant radius of curvature in the direction perpendicular thereto.

4. Rock drill bit according to claim 1, wherein the radius of the first working surface and the radius of the second working surface are qual and at least 10 percent larger than the radius of the insert body.

5. Rock drill bit according to claim 1, wherein four said inserts are peripherally spaced apart, and an additional semi-spherically shaped insert is arranged in the center of said front surface.

6. An insert for use in a rock drill bit of the impact type comprising a substantially cylindrical body and a front surface, said insert comprising a body with a generlaly cylindrical jacket surface defining a central longitudinal axis and a head section, said insert adapted to be mounted in the front surface such that said head section protrudes outwardly from the front surface, said head section being substantially circular as viewed in a longitudinal direction and provided with first and second working surfaces, said first working surface being arched in at least one direction, said second working surface being spherical and configured as substantially one-quarter of a sphere, a part of a junction between said first working surface and said jacket surface comprising a beveled transition surface such that said head section is configured asymmetrically about an imaginary plane which contains said longitudinal axis and which imaginary plane is oriented such that said transition surface and said second working surface lie on opposite sides of said plane.

7. Rock drill bit according to claim 6, wherein said first working surface has a larger radius of curvature in the radial direction of the rock drill bit than in a direction perpendicular to the radial direction.

8. Rock drill bit according to claim 6, wherein the first working surface has a generally straight extension in the radial direction of the rock drill bit and a constant radius of curvature in the direction perpendicular thereto.

9. Rock drill bit according to claim 6, wherein the radius of the first working surface and the radius of the second working surface are equal and at least 10 percent larger than the radius of the insert body.

* * * * *